US007682184B2

(12) United States Patent
Ko et al.

(10) Patent No.: US 7,682,184 B2
(45) Date of Patent: Mar. 23, 2010

(54) FFC CONNECTOR WITH ENHANCED STRUCTURE

(75) Inventors: David Tso-Chin Ko, Cypress, CA (US); Jin-Cheng Yao, Kunshan (CN); Guo-Hua Yang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/074,336

(22) Filed: Mar. 3, 2008

(65) Prior Publication Data

US 2008/0214044 A1 Sep. 4, 2008

(30) Foreign Application Priority Data

Mar. 2, 2007 (CN) ..... 2007 2 0034873

(51) Int. Cl.
*H01R 12/24* (2006.01)

(52) U.S. Cl. ..... 439/495

(58) Field of Classification Search ..... 439/492–499
See application file for complete search history.

(56) References Cited

U.S. PATENT DOCUMENTS 6,089,904 A 7/2000 Wu
6,089,905 A * 7/2000 Shimmyo et al. ..... 439/495
6,685,495 B1 * 2/2004 Ko ..... 439/497
6,932,648 B1 * 8/2005 Chiu et al. ..... 439/497
7,223,120 B2 * 5/2007 Ko ..... 439/492
2006/0134969 A1 * 6/2006 Takaku et al. ..... 439/495

FOREIGN PATENT DOCUMENTS

TW I238572 8/2005
TW I259619 8/2006

* cited by examiner

*Primary Examiner*—Briggitte R Hammond
(74) *Attorney, Agent, or Firm*—Wei Te Chung; Andrew C. Cheng; Ming Chieh Chang

(57) ABSTRACT

An FFC connector according to the present invention includes a FFC (1) and an insulator (3). The FFC defines upper and lower surfaces (10) and (11) opposite to each other, a number of gold fingers (101) formed with the upper surface and exposed outside to contact with a complementary connector, and a reinforcement plate (4) held on the lower surface and supporting the gold fingers during mating with the complementary connector. The insulator abuts against the upper surface of the FFC and has a receiving room (310) for receiving the FFC.

17 Claims, 7 Drawing Sheets

FFC CONNECTOR WITH ENHANCED STRUCTURE

BACKGROUND OF THE INVENTION

1. Field of the Invention

This invention generally relates to a FFC connector, and more particularly, to a FFC connector which has an enhanced structure to enhance hardness of FFC.

2. Description of the Prior Art

Conventionally, an FFC connector includes a housing with a plurality of terminals assembled therein. The housing further defines an elongate slot for receiving an inserted FFC cable. Each terminal includes a spring arms extending into the elongate slot such that conductors of the inserted FFC cable abut against to those spring arms thereby making electrical connection therebetween. When the FFC is inserted, it needs first to deflect those spring arms as they are interfering the course of insertion of the FFC. As a matter of fact, those spring arms create a great deal of normal force, which needs an equivalent or even stronger insertion force to balance it.

In order to provide an easy insertion of the FFC cable, an actuator is introduced to a FFC connector to facilitate electrical connections between conductors of the cable and terminals within the connector after the FFC is freely inserted, and then the actuator is actuated to make the connections. In this arrangement, the terminals within the FFC connector will not block the insertion path of the FFC cable during insertion of the FFC cable, i.e. zero insertion force. When the FFC cable is fully inserted, the actuator is then actuated such that the conductors of the inserted FFC contact with the terminals of the FFC connector. However, not only will this increase the height of the FFC connector, but will also complicate the assembling process.

Taiwanese Patent 1259619 discloses another type of FFC connector. The connector comprises a FFC and an insulator. The FFC has upper and below surfaces, and the upper surface has a plurality of gold fingers. The insulator is mounted on the below surface of the FFC, and makes the FFC rigid enough to be inserted into a complementary connector and directly contact with the terminals of the complementary connector.

BRIEF SUMMARY OF THE INVENTION

It is an object of the present invention to provide an FFC connector with a FFC directly contacting with a complementary connector.

In order to attain the object above, an FFC connector according to the present invention comprises a FFC and an insulator. The FFC defines upper and lower surfaces opposite to each other, a plurality of gold fingers formed with the upper surface and exposed outside to contact with a complementary connector, and a reinforcement plate held on the lower surface and supporting the gold fingers during mating with the complementary connector. The insulator abuts against the upper surface of the FFC and has a receiving room for receiving the FFC.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Reference will now be made in detail to the preferred embodiment of the present invention.

Please referring to FIGS. 1-7, an FFC connector according to the present invention comprises a FFC (flexible flat cable) 1, an insulator 3 disposed onto the FFC 1, a reinforcement plate 4 cooperating with the insulator 3 to hold the FFC 1, and a shell 2, 5 shielding the FFC 1.

Figure 1:
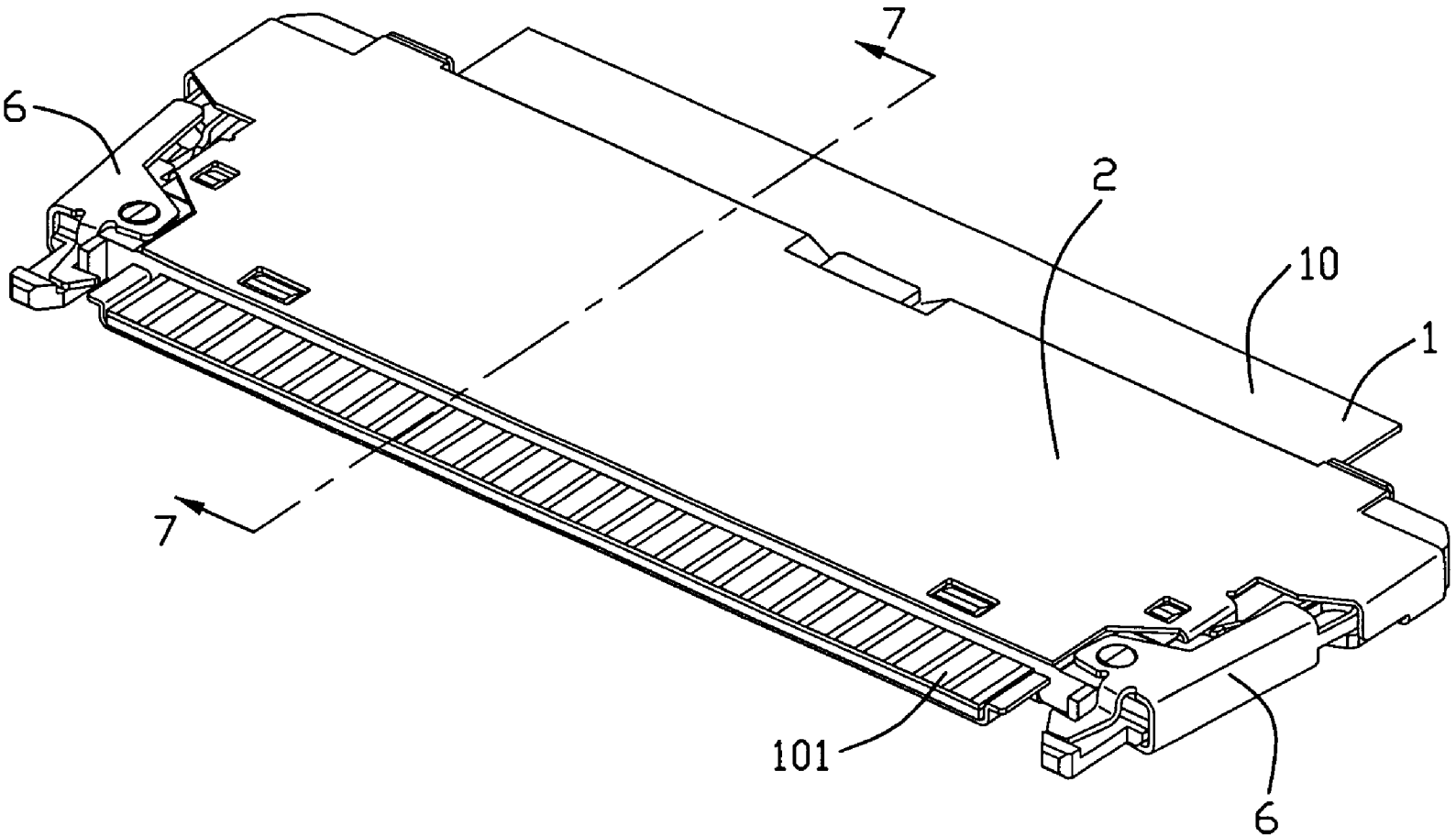
FIG. 1 is an assembled view of an FFC connector according to the present invention.
Figure 2:
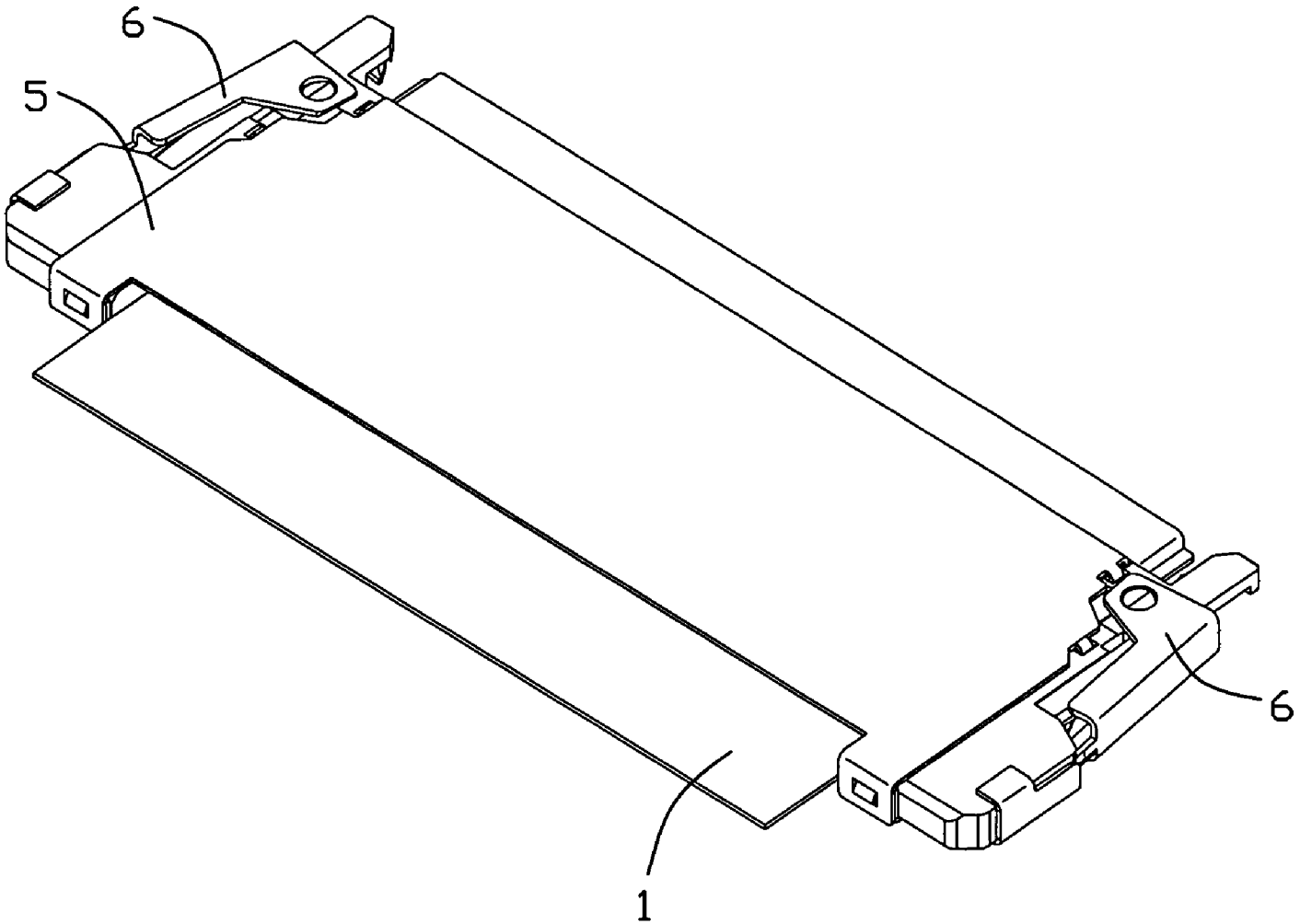
FIG. 2 is a view similar to FIG. 1, but viewed from another aspect.
Figure 5:
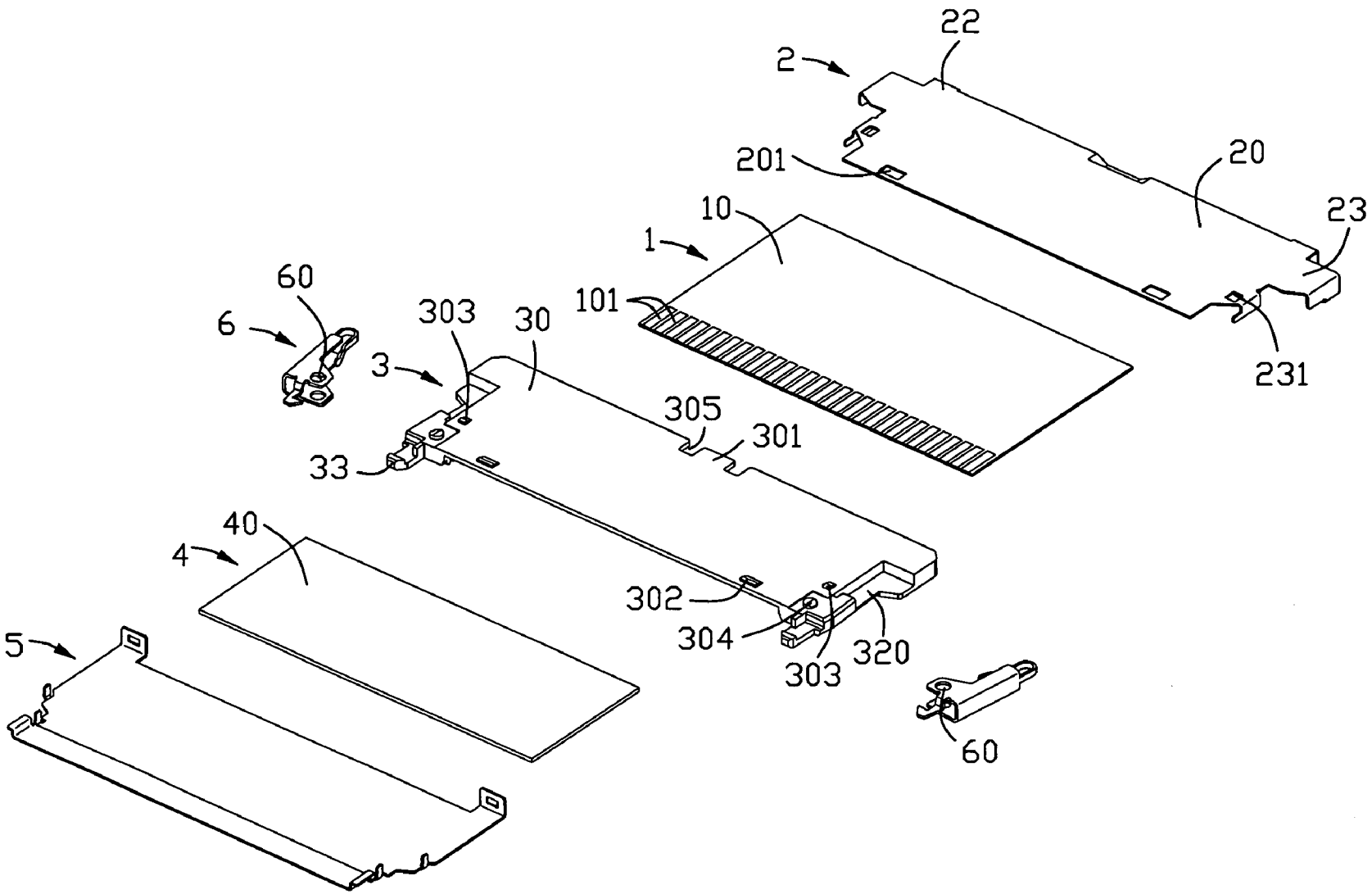
FIG. 5 is an exploded, perspective view of the FFC connector.
Figure 6:
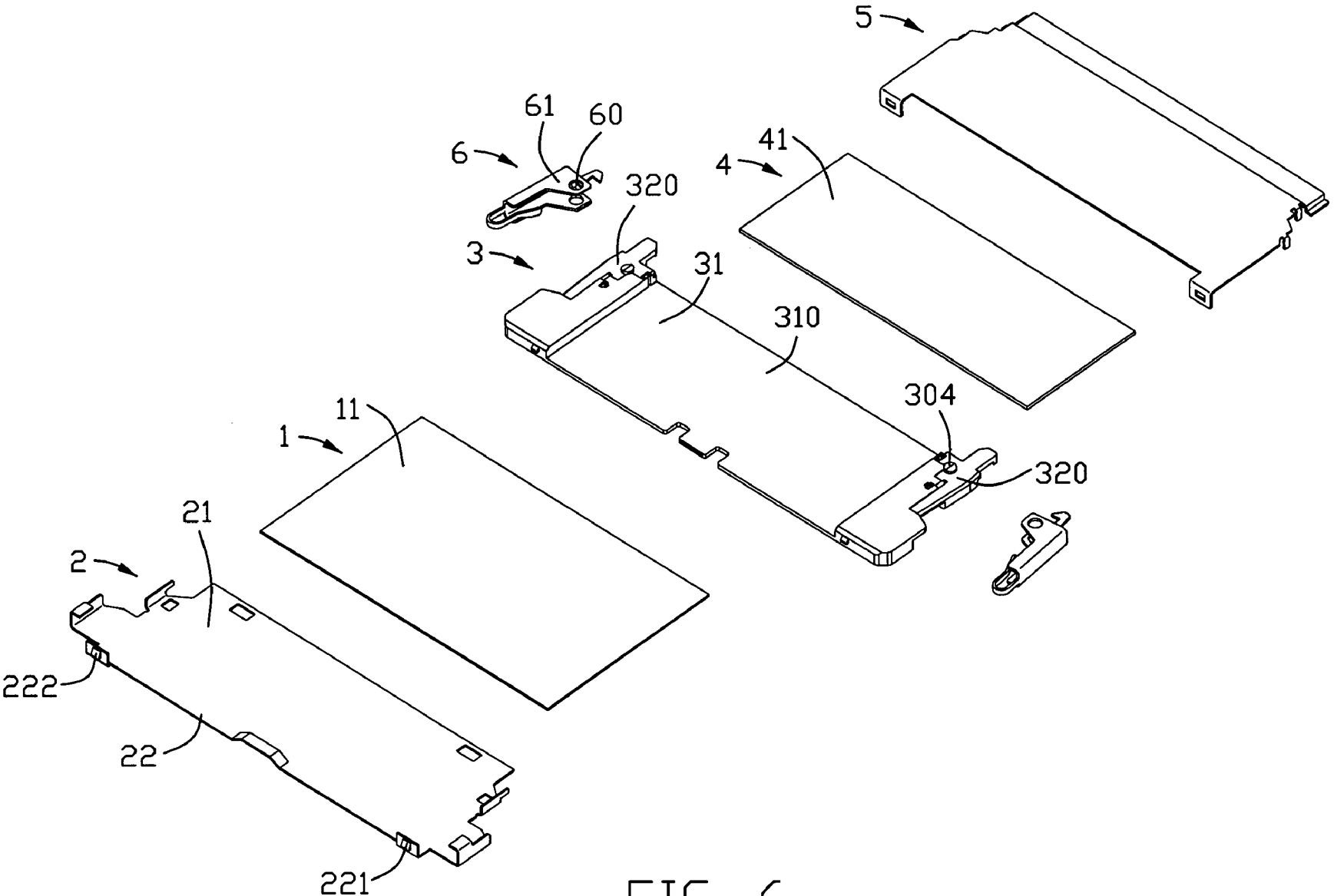
FIG. 6 is a view similar to FIG. 5, but viewed from another aspect.
Figure 7:
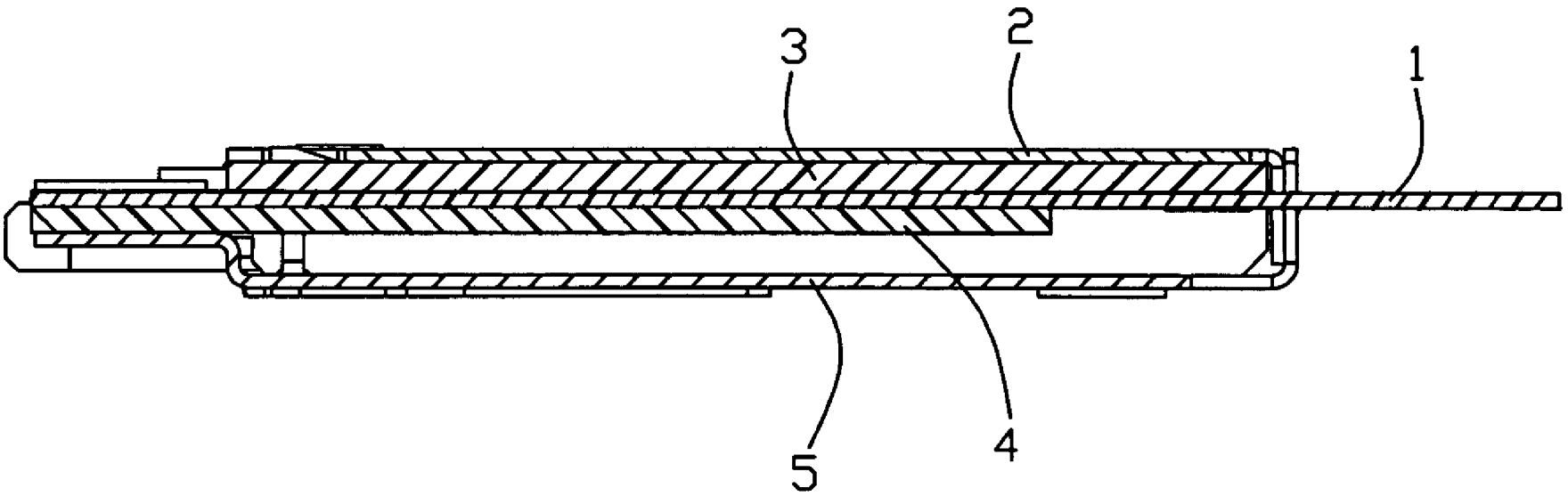
FIG. 7 is an cutaway view along Line 7-7 of the FFC connector.

Please referring to FIGS. 1, 5 and 6, the FFC 1 is configured by a plurality of electrical conductors laminated between upper and lower insulative sheets 10 and 11. A portion of the upper sheet 10 is removed to expose the conductors for electrically interconnection with other connector. A plurality of gold fingers 101 are disposed on the front portion of the FFC 1, and cover and contact with the exposed conductors so that it becomes easy to insert the FFC 1 into other connector.

The insulator 3 covers the upper surface 10 of the FFC 1, with the gold fingers 101 exposed outside. The insulator 3 comprises upper and lower surfaces 30 and 31 opposite to each other, and a flattened base portion with sidewalls 32 at ends thereof so as to jointly define a receiving room 310 thereunder. A pair of L-shaped latch receiving rooms 320 are recessed from the edges of the upper surface 30 to receive a pair of latches 6. A pair of cylindrical posts 304 are formed with the sidewalls 320 to coordinate with the latch 6. A pair of first wedge projections 302 are formed near the gold fingers 101 in the front of the upper surface 30, and a pair of second wedge projections 303 are formed near the sidewalls 32 in the back of the first wedge projections 302. A pair of notches 305 are formed in the middle of the rear portion of the upper surface 30 and spaced from each other, and a tip 301 is defined between the pair of notches 305. A pair of guiding posts 33 extend forwards from the sidewalls 32.

The reinforcement plate 4 is made of Polyethylene Terephthalate, and pasted onto the lower surface 11 of the FFC 1 to increase the rigidity of the FFC 1. The reinforcement plate 4 has upper and lower surface 40 and 41.

The latch 6 is made of metal and mounted on the insulator 3. The latch 6 comprises a body portion 61 disposed in the latch receiving room 320 and a pair of dowel holes 60 for receiving the cylindrical post 304 so as to hold the latch 6 thereon.

Figure 3:
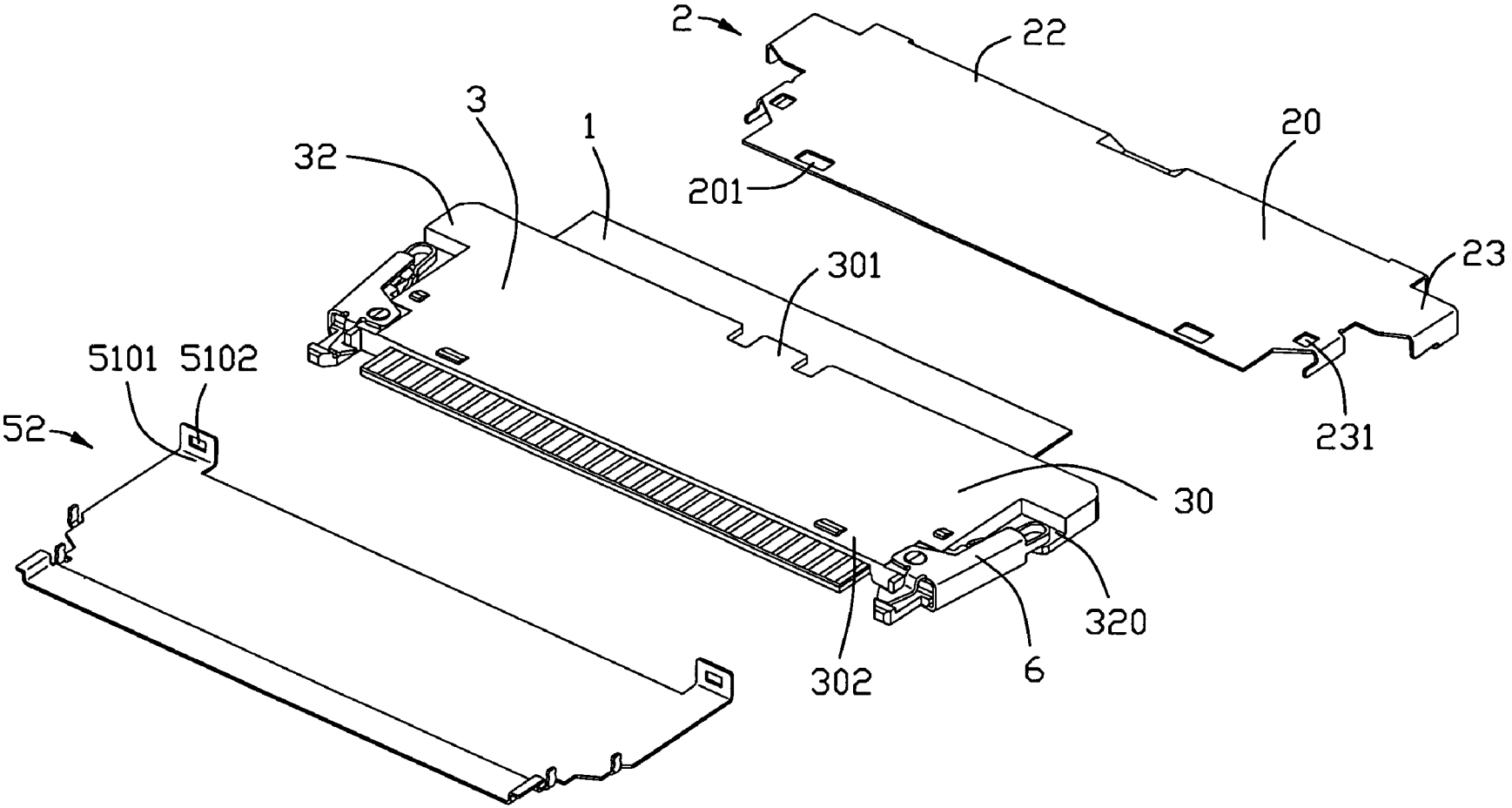
FIG. 3 is an assembled view before upper and lower shells are mounted onto the FFC connector.
Figure 4:
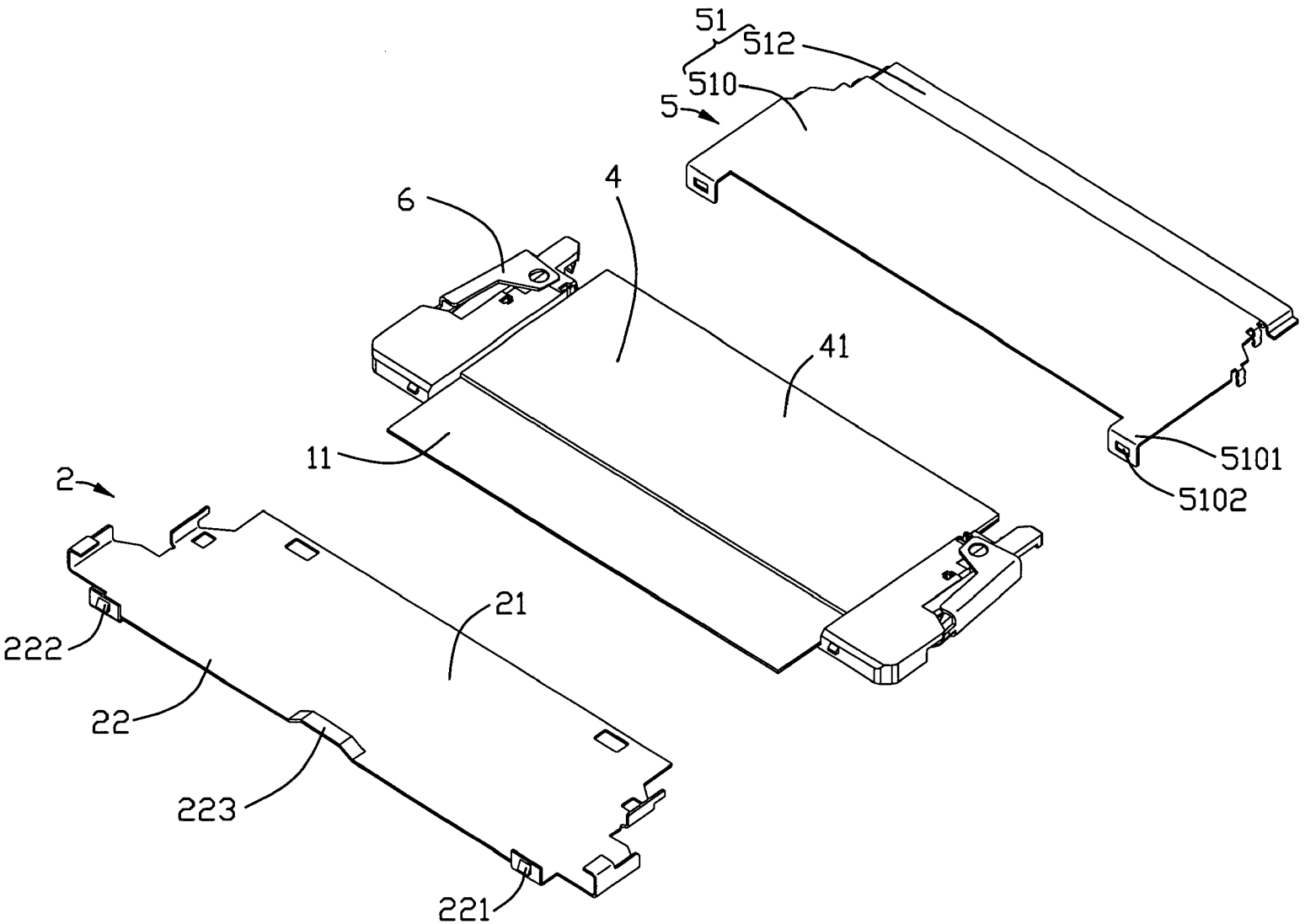
FIG. 4 is a view similar to FIG. 3, but viewed from another aspect.

Please referring to FIGS. 3, 5 and 6, the metallic shell comprises upper and lower shells 2 and 5 which are mounted on the upper surface 30 of the insulator 3 and the lower surface 10 of the FFC 1. The upper shell 2 comprises an upper surface 20, a lower surface 21, a rear end 22 and side portions 23. A pair of first rectangular receiving holes 201 are formed in the front of the upper surface 20 to receive the first wedge projections 302. A pair of second rectangular receiving holes 231 are formed in the front of the side portions 23 to receive the second wedge projections 303. A arched groove 223 is recessed in the middle of the rear end 22 to receive the tip 301 of the insulator 3, with the lateral walls (not labeled) of the arched groove 223 interfering with the notches 305. A pair of rectangular holes 221 with two spring tabs 222 defined therein extend downwards from the rear end 22 to hold the upper shell 2 on the insulator 3.

The lower shell 5 comprises a base 510 covering the FFC 1 and a tongue plate 512 extending forwards and upwards from the base 510. The inner surface of the tongue plate 512 abuts against the lower surface 41 of the reinforcement plate 4 to support the gold fingers 101. A pair of ear portions (not labeled) extend upwards from the lateral sides of the tongue plate 512 and cooperate with the tongue plate 512 to surround the gold fingers 101. A pair of rectangular holding portions 5101 with a pair of rectangular holes 5102 defined therein extend upwards from the rear end of the base 510 to hold the lower shell 5 on the insulator 3.

In assembly, the insulator 3 is fixed on the upper surface 10 of the FFC 1, with the FFC 1 received in the receiving room 310 and the gold fingers 101 extending beyond the insulator 3. The latch 6 is mounted on the latch receiving room 320 of the insulator 3, with the body portion 61 covering the latch receiving room 320 and the dowel hole 60 receiving the cylindrical post 304, so the latch 6 is pivoted to provide a reliable engagement with a complementary connector. The upper shell 2 is mounted along the rear-and-front direction on the insulator 3, with the first wedge projections 302 received in the first rectangular receiving holes 201 and the second wedge projections 303 received in the second rectangular receiving holes 231. The arched groove 223 receives the tip 301 of the insulator 3, with the lateral walls (not labeled) of the arched groove 223 interfering with the notches 305. The reinforcement plate 4 is held onto the lower surface 11 of the FFC 1. The lower shell 5 is mounted on the lower surface 11 of the FFC 1, with the tongue plate 512 abutting against the reinforcement plate 4. The gold fingers 101, the reinforcement plate 4 and the tongue plate 512 is configured in such a way to suit to mate with the complementary connector. The rectangular holding portions 5101 of the lower shell 5 matches with the rectangular holes 221 of the upper shell 2, with the spring tabs 222 received in the rectangular holes 5102, to hold the upper and lower shells 2 and 5 together.

Gold fingers 101 of the FFC 1 connect directly to the terminals of a complementary connector for signal transmission, so it can eliminate the need for a separate terminal, and reduce manufacturing and assembly costs and reduce signal loss.

In this embodiment of the invention, the insulator 3 which is installed on the upper surface 10 of the FFC 1 decreases the thickness of the lower part of the FFC connector, because the insulator 3 is thicker than the reinforcement plate 4. So the FFC connector is particularly applicable to the series of mating ports whose bottom parts have narrow space. In addition, as the upper part of the FFC connector suffers the bulk of the external impact, the insulator installed on the upper surface 10 of the FFC strengthens the FFC's resistance to impact. At the same time, the insulator which has sides portions is suitable to mount the latches 6 on so that the FFC connector can stably mate with the complementary connector.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A FFC connector, comprising:

a FFC defining upper and lower surfaces opposite to each other, a plurality of gold fingers formed with the upper surface and exposed outside to contact with a complementary connector, and a reinforcement plate held on the lower surface and supporting the gold fingers during mating with the complementary connector;

an insulator abutting against the upper surface of the FFC and having a receiving room for receiving the FCC; and a metal shell covering the insulator and the reinforcement plate.

2. The FTC connector according to claim 1, wherein the insulator comprises a plurality of wedge projections, and the shell comprises a plurality of rectangular receiving holes to receive the wedge projections.

3. The FFC connector according to claim 1, wherein the insulator comprises a tip, and the shell comprises an arched groove recessed in the middle of the rear end of the shell to receive the tip.

4. The FFC connector according to claim 1, wherein the metal shell comprises an upper defining a spring tab and a lower shell defining a rectangular hole, and the spring tab is received into the rectangular hole.

5. The FFC connector according to claim 1, wherein the reinforcement plate is held on the lower surface of the FFC by gluing.

6. The FFC connector according to claim 1, wherein further comprises a pair of latches mounted on the insulator to engage with the complementary connector.

7. The FFC connector according to claim 6, wherein the insulator comprises a pair of L-shaped latch receiving rooms to receive the pair of latches.

8. The FFC connector according to claim 1, wherein the shell comprises a base covering the FFC and a tongue plate extending forwards and upwards from the base to cover the gold fingers.

9. The FFC connector according to claim 8, wherein a pair of car portions extend upwards from lateral sides of the tongue plate and cooperate with the tongue plate to surround the gold fingers.

10. A cable assembly, comprising:

an insulative housing defining a base portion with side arrangement disposed on opposite sides of the base portion, the base portion having a flat configuration with top and bottom surface and comparably thinner than the side arrangement;

a flexible cable disposed attached to a bottom surface of the base portion and disposed between the side arrangements, and with a mating portion extending forwardly beyond a front face of the base portion; and a metallic plate attached to the insulative housing, and having a reinforced portion disposed underneath the flexible cable and substantially supporting the flexible cable toward the insulative housing.

11. The cable assembly according to claim 10, wherein the reinforced portion of the metallic plate defines a base and a tongue plate extending forwards and upwards from the base and supporting the mating portion of the flexible cable.

12. The cable assembly according to claim 10, wherein an additional supporting plate is arranged between the flexible cable and the metallic plate.

13. The cable assembly according to claim 12, wherein further comprises a metallic cover attached to the insulative housing and interlocked to the metallic plate.

14. A cable assembly comprising:

an insulative housing defining a planar base;

a pair of latches pivotally mounted on two lateral sides of the housing;

a flat flexible cable defining opposite first and second surfaces with the first surface abutting against the base, and having exposed conductors on a front edge region of the first surface;

an insulative reinforcement plate supportably mounted under a front portion of the second surface of the fiat flexible cable and cooperating with the base to tightly sandwich the flat flexible cable therebetween; and a metallic shell enclosing said housing and said reinforcement plate under a condition that the conductors are exposed outside of the shell.

15. The cable assembly as claimed in claim 14, wherein said shell defines a main body enclosing and engaging the housing with a front section extending beyond the main body and only covering and engaging the reinforcement plate so that a front section of the flat flexible cable cooperates with a front section of the shell to sandwich a front section of the reinforcement plate therebetween.

16. The cable assembly according to claim 14, wherein a mating portion is comprised by three front sections of the flat flexible cable, reinforcement plate and shell, and the mating portion extends forwardly beyond a front face of the insulative housing.

17. The cable assembly according to claim 14, wherein said shell includes upper and lower covers assembled to each other.

* * * * *